US007634855B2

(12) United States Patent
Tokunaga

(10) Patent No.: US 7,634,855 B2
(45) Date of Patent: Dec. 22, 2009

(54) METHOD FOR PRODUCING INK JET RECORDING HEAD

(75) Inventor: Hiroyuki Tokunaga, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 165 days.

(21) Appl. No.: 11/192,033

(22) Filed: Jul. 29, 2005

(65) Prior Publication Data

US 2006/0028513 A1 Feb. 9, 2006

(30) Foreign Application Priority Data

Aug. 6, 2004 (JP) ..... 2004-231026

(51) Int. Cl.
*B41J 2/16* (2006.01)

(52) U.S. Cl. ..... 29/890.1; 29/25.35; 216/27; 347/68; 347/70; 427/100

(58) Field of Classification Search ..... 29/25.35, 29/890.1; 216/2, 27, 67, 68, 79, 83, 99; 347/68, 347/70; 427/100, 97.7
See application file for complete search history.

(56) References Cited

U.S. PATENT DOCUMENTS

| | | | | |
|---|---|---|---|---|
| 6,019,458 | A * | 2/2000 | Shimada et al. | 347/70 |
| 6,332,254 | B1 * | 12/2001 | Usui et al. | 29/25.35 |
| 6,382,781 | B2 * | 5/2002 | Furuhata et al. | 347/68 |
| 6,447,106 | B1 * | 9/2002 | Watanabe et al. | 347/70 |
| 6,502,930 | B1 * | 1/2003 | Shimada et al. | 347/71 |
| 6,787,052 | B1 * | 9/2004 | Vaganov | 216/57 |
| 7,108,359 | B2 * | 9/2006 | Shimosato et al. | 347/68 |
| 7,165,299 | B2 * | 1/2007 | Mita et al. | 29/25.35 |
| 2004/0021745 | A1 | 2/2004 | Mouri et al. | |
| 2004/0194309 | A1 | 10/2004 | Tokunaga et al. | |
| 2006/0027529 | A1 | 2/2006 | Tokunaga | |

FOREIGN PATENT DOCUMENTS

| | | |
|---|---|---|
| JP | 4-312852 | 11/1992 |
| JP | 9-123448 A | 5/1997 |
| JP | 2000-246898 | 9/2000 |
| JP | 3168713 B2 | 3/2001 |

* cited by examiner

*Primary Examiner*—A. Dexter Tugbang
*Assistant Examiner*—Livius R Cazan
(74) *Attorney, Agent, or Firm*—Fitzpatrick, Cella, Harper & Scinto

(57) ABSTRACT

A producing method for a liquid discharge head having a pressure generation chamber communicating with a discharge port for discharging a liquid, a piezoelectric element provided corresponding to the pressure generation chamber, and a vibration plate provided between the pressure generation chamber and the piezoelectric element, the method including:

a preparation step of preparing a flat plate-shaped substrate having a recess on a main surface thereof, a piezoelectric element forming step of forming the piezoelectric element in the recess, a vibration plate forming step of forming the flat vibration plate on the main surface of the substrate and the piezoelectric element, a pressure generation chamber forming step of forming the pressure generation chamber on the vibration plate, and a removing step of removing the substrate in at least a peripheral portion of the piezoelectric element.

7 Claims, 11 Drawing Sheets

METHOD FOR PRODUCING INK JET RECORDING HEAD

BACKGROUND OF THE INVENTION

1. Field of the Invention

The present invention relates to a producing method for a liquid discharge head (hereinafter also called "ink jet recording head") which discharges a liquid by applying an energy to the liquid.

2. Related Background Art

Recently, an ink jet recording apparatus is widely utilized, because of a satisfactory recording property and a low cost thereof, as an output apparatus of personal computers. Among such ink jet recording apparatus, there are being developed, for example, a type which generates a bubble in an ink by a thermal energy and discharges an ink droplet by a pressure wave caused by the bubble, a type which discharges an ink droplet by an electrostatic attraction, and a type utilizing a pressure wave caused by a vibrator such as a piezoelectric element.

Among the aforementioned ink jet recording apparatuses, the type utilizing the piezoelectric element has a configuration including an ink flow path communicating with an ink discharge port and a pressure generation chamber communicating with the ink flow path, in which a piezoelectric thin film, provided in the pressure generation chamber and adjoined to a vibration plate film executes an elongation-contraction when given a predetermined voltage whereby the piezoelectric film and the vibrating plate film integrally cause a vibration to compress an ink in the pressure generation chamber, thereby discharging an ink droplet from the ink discharge port.

In recent ink jet recording apparatus, improvements in the recording performance, particularly a high resolution and a high-speed recording, are being requested. For meeting such requirements, it is necessary to reduce a discharge amount of the ink droplet discharged at a time, and to execute a high-speed drive. For attaining these, Japanese Patent Application Laid-open No. 9-123448 discloses a method of reducing a volume of the pressure generation chamber, in order to reduce a pressure loss therein.

Also, though for a different purpose, Japanese Patent No. 3168713 discloses an ink jet head in which a silicon substrate having a surface orientation {110} is employed as a substrate and a {111} plane of such substrate is positioned on a lateral face of the ink pressure generation chamber. Also Japanese Patent Application Laid-open No. 2000-246898 discloses a head in which piezoelectric elements are provided in an area opposed to a cavity formed in a silicon substrate to secure rigidity of a partition between pressure generation chambers, thereby preventing a crosstalk phenomenon.

In the prior technology, it has been difficult to prepare a pressure generation chamber of a small volume in a simple process. Also a complex process is required for forming a thin vibrating plate. Because of these reasons, it has been difficult to produce an ink jet recording head, utilizing a piezoelectric thin film in a discharge pressure generating element, in an integrated state of a high density.

Also in a method for producing a piezoelectric element disclosed in Japanese Patent Application Laid-open No. 2000-246898, since the vibrating plate is hollow and bent by a large angle, a stress concentration may result in a part thereof, thus deteriorating the durability. Also as the element protrudes in the liquid chamber, there may result an increase in the resistance of the flow path, thus detrimentally affecting the discharge frequency.

SUMMARY OF THE INVENTION

An object of the present invention is to provide a method for producing an ink jet recording head, enabling to form a thinner and finer vibrating plate and capable of improving a durability of the vibrating plate.

A producing method for an ink jet recording head of the present invention is a method for producing a liquid discharge head including a pressure generation chamber communicating with a discharge port for discharging a liquid, a piezoelectric element provided corresponding to the pressure generation chamber, and a vibration plate provided between the pressure generation chamber and the piezoelectric element, the method including:

a preparation step of preparing a substrate having a recess on a main surface of a flat plate-shaped substrate, a piezoelectric element forming step of forming the piezoelectric element in the recess, a vibration plate forming step of forming the flat vibration plate on the aforementioned main surface of the substrate and the piezoelectric element, a pressure generation chamber forming step of forming the pressure generation chamber on the vibration plate, and a removing step of removing the substrate in at least a peripheral portion of the piezoelectric element.

The producing method of the invention can produce an ink jet recording head capable of achieving a thinner and finer structure of the vibration plate and improving the durability of the vibration plate.

In the ink jet recording head produced by the aforementioned producing method of the invention, since the vibration plate is formed planarly on the substrate and a space is so formed as to surround the piezoelectric element provided opposite to the pressure generation chamber across the vibration plate, it is possible to achieve a thinner and finer vibration plate and to improve the durability thereof. Also, since the piezoelectric element is surrounded by wall faces of the substrate constituting the space, it is rendered possible to suppress a breakage or a distortion in the piezoelectric element or the vibration plate in an assembling step of the ink jet recording head. Also, since the entire vibration plate is supported by the substrate, the ink jet recording head has a high mechanical strength. Furthermore, since the vibration plate, having a flat shape in the pressure generation chamber, does not deteriorate the flow resistance therein and enables an increase in the liquid discharge frequency.

DETAILED DESCRIPTION OF THE PREFERRED EMBODIMENTS

In the following, embodiments of the present invention will be explained with reference to the accompanying drawings.

Figure 1:
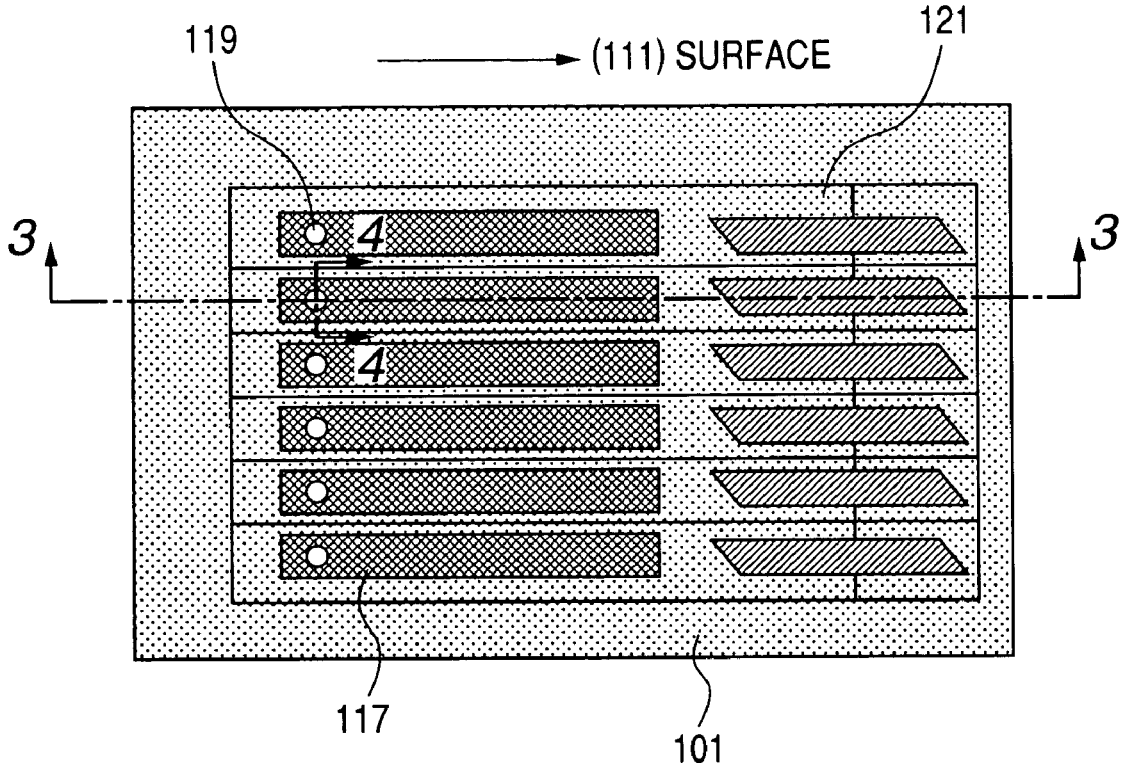
FIG. 1 is a plan view of an ink jet recording head constituting an embodiment of the present invention.
Figure 2:
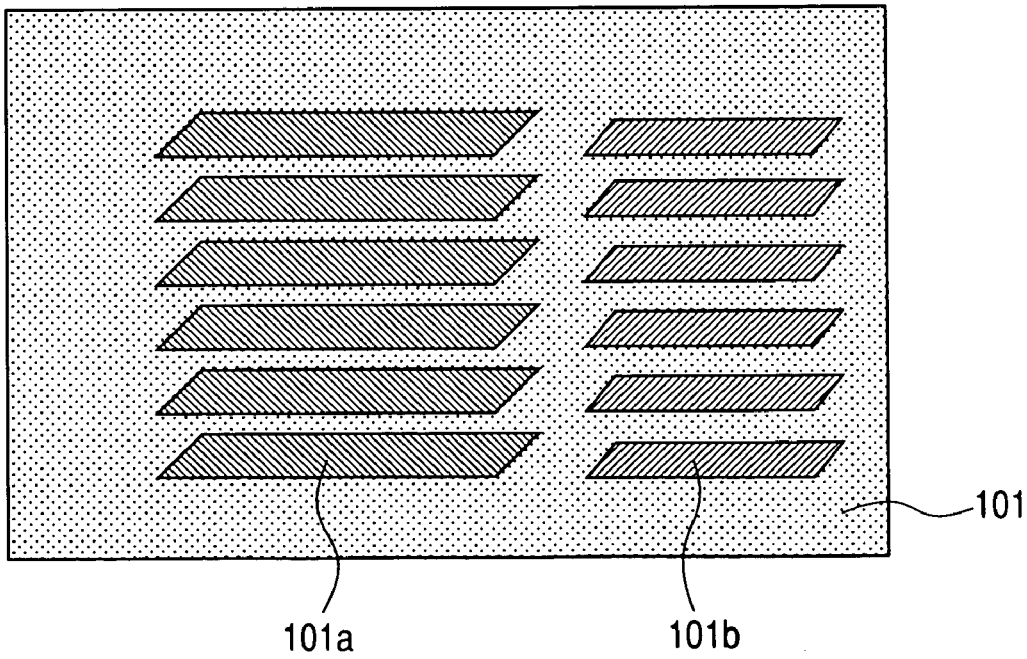
FIG. 2 is a bottom view of the ink jet recording head shown in FIG. 1.
Figure 3:
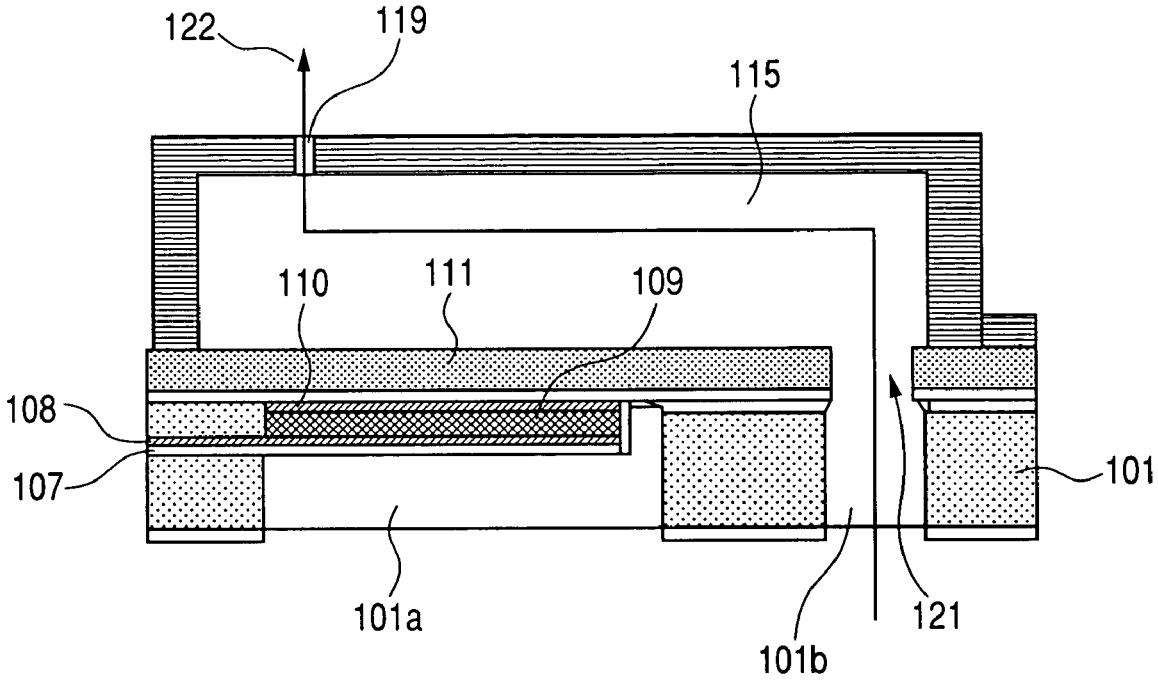
FIG. 3 is a cross-sectional view along a line 3-3 in FIG. 1.
Figure 4:
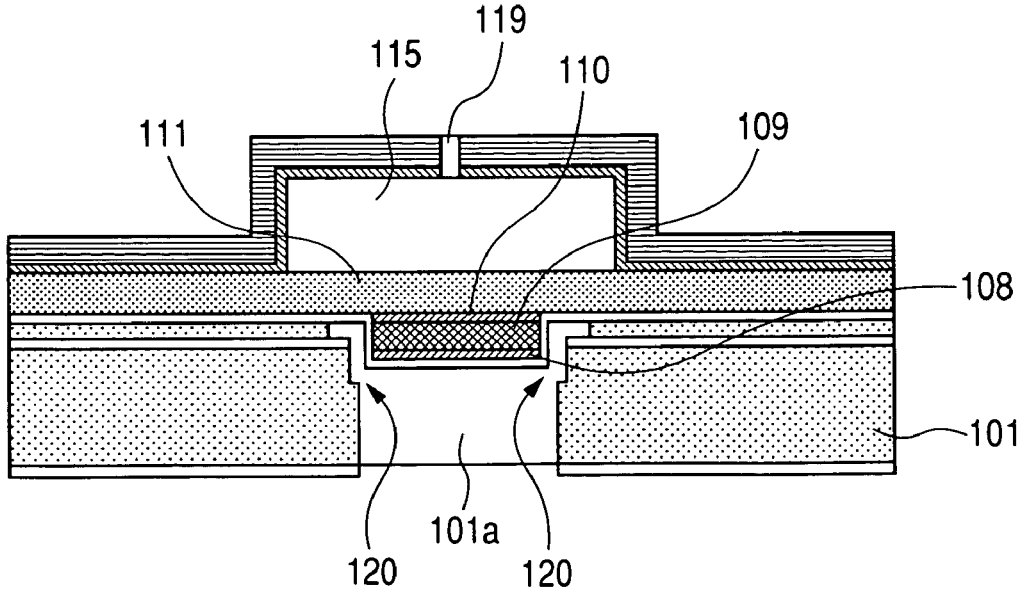
FIG. 4 is a cross-sectional view along a line 4-4 in FIG. 1.

FIG. 1 is a plan view of an ink jet recording head in an embodiment of the present invention; FIG. 2 is a bottom view of the ink jet recording head shown in FIG. 1; FIG. 3 is a cross-sectional view along a line 3-3 in FIG. 1; and FIG. 4 is a cross-sectional view along a line 4-4 in FIG. 1.

The ink jet recording head of the invention employs, as a substrate 101, a silicon wafer having a surface orientation {110}. In the substrate 101, a rear space 101*a* behind a vibration plate 111 is formed by an anisotropic etching, and also a liquid supply aperture 101*b* for supplying a liquid from a lower surface side to an upper surface side is formed. The vibration plate 111 is substantially coplanarly with the upper surface of the substrate 101, and a pressure generation chamber 115 is so formed thereon as to cover the vibration plate. In upper portion of the pressure generation chamber 115, there is formed a discharge port 119.

On a surface of the vibration plate 111 opposite to the pressure generation chamber 115, there is provided a piezoelectric element 108-110 for driving the vibration plate thereby generating a discharge pressure. The piezoelectric element is constituted of a piezoelectric film 109, an upper electrode 110 formed on an upper surface thereof, and a lower electrode 108 formed on a lower surface thereof. The piezoelectric element 108-110 is surrounded by a space 120 formed in the substrate 101 by etching. In case the space 120 is formed in the substrate 101 by an anisotropic liquid etching, the etched face of the substrate 101, constituting the space 120, is a Si {111} plane.

In an ink jet recording head of such configuration, a liquid supplied from an unillustrated liquid reservoir, into the liquid supply aperture 101*b* and through a communicating hole 121, into the pressure generation chamber 115, is discharged, as indicated by a path 122, to the exterior through the discharge port 119 by a deformation of the vibration plate 111, and is deposited on a recording medium opposed to the discharge port 119, thereby recording an image on the recording medium.

In the following, an example of a producing process for the ink jet recording head of the present embodiment will be explained in succession with reference to FIGS. 5A to 9.

Figure 5A:
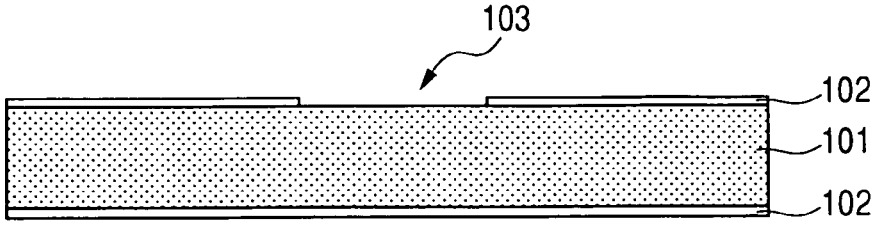
FIGS. 5A, 5B, 5C, 5D and 5E are views showing a process for producing an ink jet recording head embodying the present invention.

(1) At first, as shown in FIG. 5A, a silicon substrate 101 having a surface orientation {110} is thermally oxidized to form an oxide film 102 on both surfaces, and the oxide film 102 of the upper side is partially etched to form a predetermined pattern 103 for forming the rear space 101*a* behind the vibration plate and the liquid supply aperture 101*b*.

Figure 8:
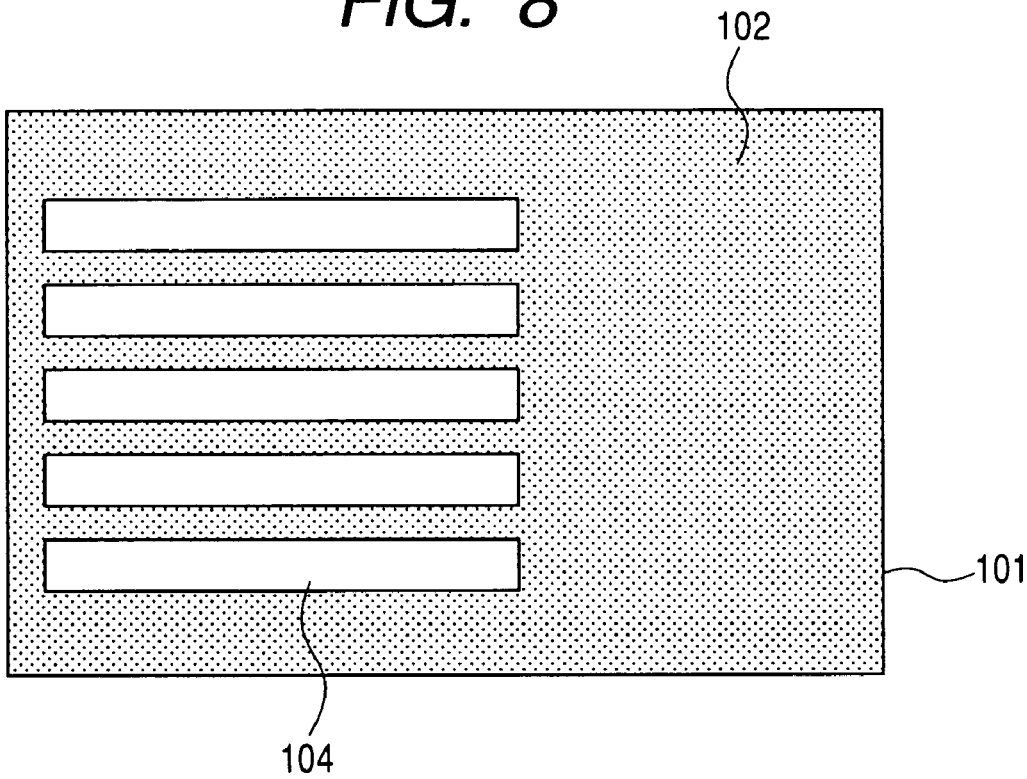
FIG. 8 is a view showing a process for producing an ink jet recording head embodying the present invention.

(2) Then, a portion of the pattern 103 is rectangularly etched, as shown in an upper view in FIG. 8, by an ion-coupled plasma etching apparatus (ICP) to form a groove (recess) 104. The groove 104 has a depth of about 2-4 μm. The groove 104 is so formed that a longer side of the rectangle becomes parallel to a plane equivalent to the {111} plane of the substrate 101.

In the following, there will be explained a process utilizing an anisotropic etching, but the surface orientation of the silicon substrate is not restricted in case of employing ICP for penetration etching of the substrate 101.

(3) Then the oxide film 102 is removed on the upper surface of the substrate 101, in a portion where the liquid supply aperture 101*b* is to be formed. Then polysilicon or amorphous silicon is deposited for example by an LPCVD method, thereby forming a sacrifice layer 105 in a portion where the liquid supply aperture 101*b* is to be formed and a surrounding portion (cf. FIG. 9).

Figure 9:
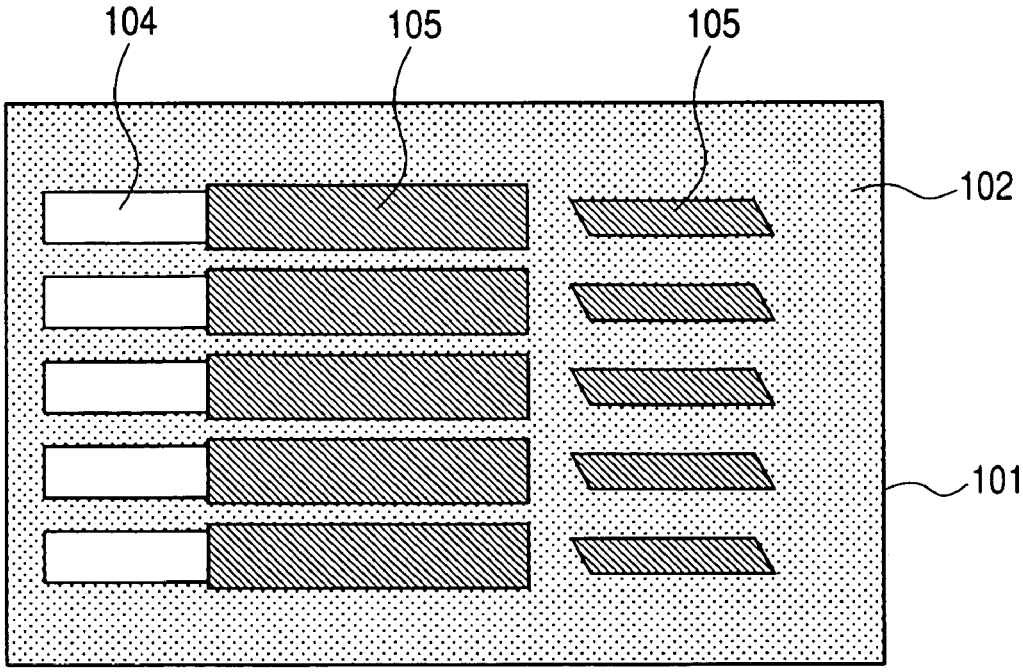
FIG. 9 is a view showing a process for producing an ink jet recording head embodying the present invention.

In this operation, the sacrifice layer 105 in a portion for constituting the liquid supply aperture 101*b* is formed, as shown in FIG. 9, in a parallelogram having a narrower angle of 70.5° in such a manner that a longer side of the parallelogram becomes parallel to a face equivalent to a (111) plane of the substrate 101.

(4) Then, on the upper surface of the substrate 101, a $Si_3N_4$ film 106 and a $SiO_2$ film 107 are deposited by a CVD method, with each thickness of 1000-4000 Å (100-400 nm).

In this step, either of the $Si_3N_4$ film 106 and the $SiO_2$ film 107 may be deposited singly.

(5) A lower electrode 108 is formed with a metal capable of withstanding a high temperature, such as Pt/Ti, matching the sacrifice layer 105 constituting a rear portion of the vibration plate 111. Then, on the lower electrode 108, a thin film for example of lead titanate zirconate (PZT) is deposited for example by a sputtering and is patterned to form a piezoelectric member portion 109. After the formation of the piezoelectric member portion 109, a calcining is executed for 5 hours at 680° C. in an oxygen atmosphere. Then, on the piezoelectric member portion 109, a metal capable of withstanding a high temperature, such as Pt/Ti, is deposited and patterned to form an upper electrode 110. A resist material employed for such patterning is also used for patterning PZT. In this manner a piezoelectric element 108-110 is formed in the groove 104.

(6) Then, as shown in FIGS. 6A to 6D, a $SiN_x$ film is deposited for example by a plasma CVD method on the upper surface of the substrate 101, and is patterned to form the vibration plate 111. The vibration plate 111 has a thickness of about 1-4 μm. Thereafter, on the upper surface of the substrate 101, the $SiO_2$ film 106 is removed by a patterning in a portion where the liquid supply aperture 101*b* is to be formed.

(7) Then, a first pattern 112, serving as a mold for forming the pressure generation chamber 115 etc. and to be removed in a later step, is formed on the vibration plate 111. It can be formed by a printing technology or a photolithographic technology, but a photolithographic method utilizing a photosensitive resin is preferable since it can form a fine pattern. A material for the first pattern 112 is preferably a material capable of a patterning of a thick film and of being removed by dissolution with an alkali solution or an organic solvent. For such material, there can be employed, for example, a THB series (manufactured by JSR Corp.) or a PMER series (manufactured by Tokyo Oka Kogyo Co.). In the following example, there is employed PMER HM-3000 manufactured by Tokyo Oka Kogyo Co. as such material, but the material is naturally not restricted thereto. A thickness of the first pattern 112 is preferably 60 μm or less in case of formation by a coating process or 90 μm or less even in case of formation by plural coatings, in consideration of a film thickness distribution and a patterning property.

(8) Then, a conductive layer 113 is formed for example by a sputtering on the first pattern 112. The conductive layer 113 can be constituted of Pt, Au, Cu, Ni, or Ti. Since a fine pattern cannot be formed unless the resin (first pattern 112) and the conductive layer 113 have an adhesion of a certain level, the conductive layer 113 may be formed by forming a film of Pt, Au, Cu, Ni etc. after a film of another metal is formed on the first pattern 112. Since the conductive layer 113 has to be removed, in a later step of removing the first pattern 112, in a portion corresponding to the discharge port 119 (cf. FIG. 3), a thickness of the conductive layer 113 is preferably 1500 Å (150 nm) or less, and most preferably 1000 Å (100 nm) or less. In case the thickness of the conductive layer 113 exceeds 1500 Å, the conductive layer 113 in the portion of the discharge port 119 may not be removed completely in the step of removing the first pattern 112.

Subsequently, on the first pattern 112 bearing the conductive layer 113, there is formed a second pattern 114 for forming the discharge port 119 upon a removal later. For a material of the second pattern 114, there can be employed, for example, a THB series (manufactured by JSR Corp.) or a PMER series (manufactured by Tokyo Oka Kogyo Co.). In the following example, there is employed PMER LA-900PM manufactured by Tokyo Oka Kogyo Co. as such material, but the material is naturally not restricted thereto and there may be employed another material capable of a patterning of a thick film and of being removed by dissolution with an alkali solution or an organic solvent. The second pattern 114 preferably has a thickness of 30 μm or less, since it requires a higher patterning precision than in the first pattern 112. It is thus preferable that first pattern 112 and the second pattern 114 have a total thickness of 120 μm or less.

In order that the pressure generated in the pressure generation chamber 115 can be efficiently utilized as a discharge pressure, both the first and second patterns 112, 114 preferably have a tapered shape in which an upper surface side is smaller than a lower surface side. An optimum tapered shape of the first and second patterns 112, 114 can be determined for example by a computer simulation. The tapered shape may be formed by various methods, and, in case of employing an exposure apparatus of proximity type, it can be formed by gradually increasing a distance (gap) between the substrate 101 and a mask (not shown), in the course of an exposure. It can also be formed for example by utilizing a gray scale mask. A fine discharge port can be formed naturally more easily with a reduction exposure of ⅕ or 1/10. Also a gray scale mask allows to form not only a simple tapered shape but also a complex shape such as a spiral shape.

(9) Then, a flow path structural member 118, constituting a liquid flow path including the pressure generation chamber 115 and the discharge port 119, is formed by a plating process. The plating process includes an electrolytic plating and an electroless plating, which may be suitably selected. The electrolytic plating is advantageous in that a processing liquid is inexpensive and that a waste liquid treatment is simple. The electroless plating is superior in providing a better coverage of plating, in that a uniform film can be formed, and in that the plated film is hard and antiabrasive. As an example of such selection, a flow path structural member 118 can be formed by at first forming a thick Ni layer by an electrolytic plating, and then forming a thin Ni-PTFE composite plated layer. In such case, there can be obtained an advantage that a plated layer of desired film characteristics can be obtained inexpensively.

The plating material can be a plating of a single metal such as Cu, Ni, Cr, Zn, Sn, Ag or Au, a plating of an alloy or a composite plating for precipitating for example PTFE (polytetrafluoroethylene). Ni is employed preferably in consideration of a chemical resistance and a strength. Also a Ni-PTFE composite plating or the like is employed for providing the plated film with water repellency.

(10) In order to protect an upper surface side of the substrate 101, prepared in the foregoing steps, from an etchant to be employed in later steps, the upper surface side of the substrate 101 is covered with a resin 116 that is resistant to alkali and is removable later with an organic solvent of the like. The present embodiment utilizes covering the upper surface side of the substrate 101 with the resin 116, but it is also possible to employ a method of mounting the substrate 101 on a jig that can contact only the lower surface side of the substrate 101 with the etchant.

(11) Subsequently, the oxide film 102 on the lower surface side of the substrate 101 is partially etched to form predetermined patterns for forming the rear space 101*a* behind the vibration plate and the liquid supply aperture 101*b*. Such patterns have a parallelogram shape as shown in FIG. 2. Also in a vicinity of a narrower angled portion of the parallelogram on the lower surface side of the substrate 101, a leading hole (not shown) may be formed for example by a laser working. It is thus made possible, in the anisotropic etching of the substrate 101, to suppress that the {111} face of the substrate 101 is inclined by an oblique etching resulting from the narrow angle portion of the parallelogram. Such leading hole is preferably extended as close as possible to an etching stop layer. A depth of the leading hole is generally 60% or more of the thickness of the substrate 101, preferably 70% or more and most preferably 80% or more. Naturally the leading hole should not penetrate through the substrate 101.

A rear space 101*a* and a liquid supply aperture 101*b* of a parallelogram planar shape can be formed in the substrate 101 by immersing the substrate 101 in an etchant and executing an anisotropic etching so as to expose a {111} plane.

An alkaline etchant employable in this operation can be KOH (potassium hydroxide) or TMAH (tetramethyl ammonium hydride), and TMAH can be employed advantageously in consideration of the environment.

After the etching, the resin 116, constituting an alkali-resistant protective film, is dissolved and removed for example with an organic solvent. In case of utilizing a jig, the substrate 101 is detached from the jig. Then the sacrifice layer 105, serving as an etching stop layer, is removed for example by a dry etching. In this manner a space 120 surrounding the piezoelectric element 108-110 is formed.

(12) Finally, the first and second patterns 112, 114 for forming the flow path containing the pressure generation chamber 115 and the discharge port 119 are removed with an alkali solution or an organic solvent.

The ink jet recording head shown in FIG. 1 is completed by the steps explained above.

However, the process for producing the ink jet recording head is not limited to that explained above, and, for example, the substrate 101 may be etched, instead of the anisotropic etching utilizing an etchant, by an etching by ICP (inductively coupled plasma). In this case, the first embedding step for the sacrifice layer 105 becomes unnecessary. Also as to the formation seeds for plating, an area or a procedure for forming the seeds for plating may be changed.

EXAMPLE 1

In the following, an example of the ink jet recording head of the present invention will be explained with reference to FIGS. 1 to 4.

The present example employed, as the substrate 101, a Si {110} wafer of a thickness of 635 μm. On the substrate 101, a piezoelectric element 108-110 was provided on the lower surface side of a vibrating plate 111, then a rear space 101*a* behind the vibration plate was formed by an anisotropic etching of the substrate 101, and a space 120 was formed around the piezoelectric element 108-110. At the same time, a liquid supply aperture 101*b* was formed in the substrate 101.

The vibration plate 109 was formed by depositing $SiN_x$ with a thickness of 2 μm on the upper surface of the substrate 101, followed by a patterning.

A piezoelectric film 109 was formed by depositing lead titanate zirconate (PZT) with a thickness of 2 μm, followed by a patterning. An upper electrode 110 was formed by depositing Pt/Ti with respective thicknesses of 1500/50 A (150/5 nm), followed by a patterning. A lower electrode 108 was formed by depositing Pt/Ti with respective thicknesses of 1500/50 A (150/5 nm), followed by a patterning. At the lower surface side of the piezoelectric element 108-110, $SiO_2$ was deposited with a thickness of 2000 Å (200 nm) and patterned to form a protective film 107. Since a space 120 is formed around the piezoelectric element 108-110, the piezoelectric element 108-110 and the vibration plate 111 in a deformed state do not touch the substrate 101 and can therefore be sufficiently displaced without any restriction in the deformation thereof.

The vibration plate 111 had a shorter side of 67 μm and a longer side of 3 mm, and the vibration plate 111 with such dimensions showed a maximum displacement of 160 nm.

On the substrate 101, a pressure generation chamber 115 was formed individually. The pressure generation chamber 115 had a wall member constituted of Ni and formed by a plating process. In the pressure generation chamber 115, an internal wall had a height of 60 μm and a wall member had a thickness of 20 μm. The pressure generation chamber 115 was provided, at an end thereof, with a communicating hole for causing each pressure generation chamber to communicate with a common liquid chamber.

In an upper part of the other end of the pressure generation chamber 115, there was formed a discharge port 119 having a diameter of 20 μm at an upper end of the aperture and a diameter of 30 μm at a lower end. Thus, by a deformation of the vibration plate 111, the liquid in the pressure generation chamber 115 is discharged through a path indicated by 122 and through the discharge port 119, whereby the discharged liquid is deposited on a recording medium to record an image.

FIG. 1 is a view showing an upper surface of the ink jet recording head shown in FIG. 3, but the electrodes etc. are omitted from the illustration.

In the present example, 150 pressure generation chambers 150 were arranged in parallel, along a direction perpendicular to the Si {111} plane of the substrate 101. A pitch of array of the nozzles (pitch of array of the discharge ports 119) was selected as 84.7 μm. Each pressure generation chamber 115 was so formed that a longitudinal direction thereof was parallel to the {111} plane of the substrate 101.

FIG. 2 is a view showing a lower side of the ink jet recording head shown in FIG. 3.

In the present example, the rear space 101*a* behind the vibration plate and the liquid supply aperture 101*b* were so formed by etching that a longer side of a parallelogram, having a narrower angle of 70.5°, was positioned parallel to the Si {111} plane of the substrate 101. The rear space 101*a* behind the vibration plate had a longer side of 2.7 mm, and the liquid supply aperture 101*b* had a longer side of 500 μm.

In the ink jet recording head of the present example constructed as described above, since the piezoelectric element 108-110 and the vibration plate 11 are surrounded by walls constituting the rear space 101*a* behind the vibration plate of the Si substrate 101, the piezoelectric element 108-110 can be more securely protected and were not destructed in an electrical mounting operation of the recording head. Also the recording head has a high mechanical strength since the entire vibration plate 111 is supported by the substrate 101. Furthermore, the vibration plate 111, being planar in the pressure generation chamber 115, does not increase the flow resistance therein, so that the discharge frequency for the liquid can be elevated.

In this recording head, an aqueous ink of a viscosity of 2 cp ($2\times10^{-3}$ Pa·s) was discharged from the discharge port 119 in a droplet of 1.5 pl at a discharge frequency of 20 kHz. As a result, a recording of a high quality, without a discharge failure, was obtained over a width of 12.5 mm along the array of the nozzles of the recording head.

EXAMPLE 2

In the following, an example of a producing process for the ink jet recording head of the present invention will be explained with reference to FIGS. 5A to 9.

Figure 5B:
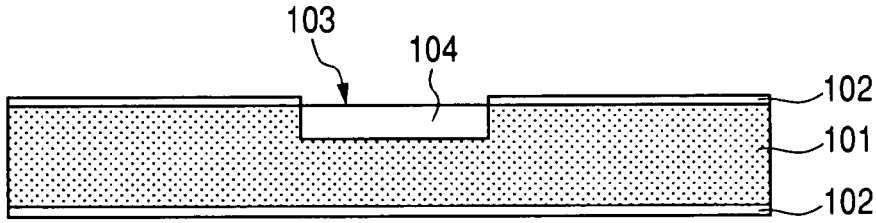

(1) A silicon substrate 101 having an external diameter of 150 mm, a thickness of 630 μm and a surface orientation {110} was thermally oxidized to form an oxide film 102, and the oxide film 102 of the upper side was partially etched to form a pattern 103 (FIG. 5A), and a portion of the pattern 103 was rectangularly etched, as shown in an upper view in FIG. 8, by an ion-coupled plasma etching apparatus (ICP) to form a groove 104 (FIG. 5B). The groove 104 had a depth of 3 μm. The rectangular groove 104 so formed with a longer side of 3 mm, and a shorter side of 70 μm, and that the longer side became parallel to a plane equivalent to the {111} plane.

Figure 5C:
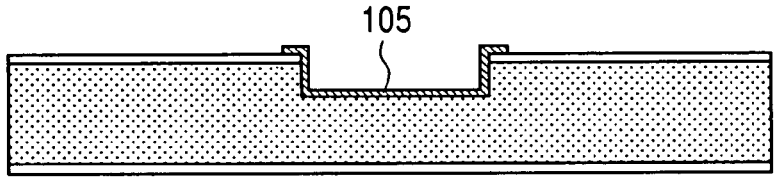

(2) Then the oxide film 102 in a portion corresponding to the liquid supply aperture 101*b* was removed, and a polysilicon film was deposited by an LPCVD method with a thickness of 3000 Å (300 nm) thereby forming a sacrifice layer 105 in a portion corresponding to the liquid supply aperture 101*b*, the groove 104 and the surrounding area thereof (FIG. 5C).

In this operation, the sacrifice layer 105 in a portion for constituting the liquid supply aperture 101*b* was formed, as shown in FIG. 9, in a parallelogram having a narrower angle of 70.5° in such a manner that a longer side and a shorter side of the parallelogram become parallel to faces equivalent to a (111) plane.

Figure 5D:
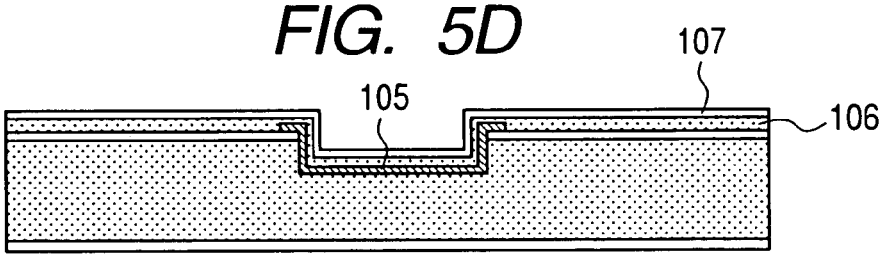

(3) Then, on the substrate 101, a $Si_3N_4$ film 106 as an etching stop layer was deposited by an LPCVD method with a thickness of 3000 Å (300 nm) and a $SiO_2$ film 107 was deposited thereon by a thermal CVD method, with a thickness of 2000 Å (200 nm) (FIG. 5D).

Figure 5E:
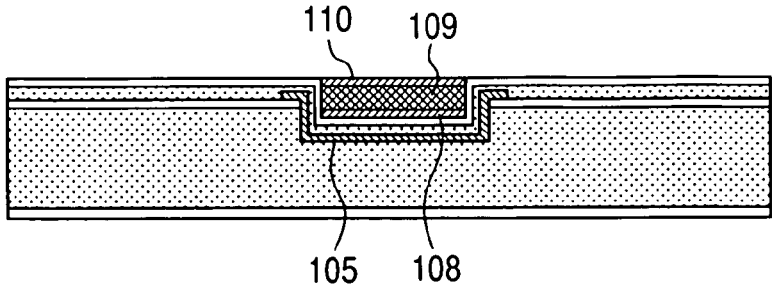

(4) A lower electrode 108 was formed by depositing Pt/Ti with respective thicknesses of 1500/50 Å (150/5 nm), followed by patterning, matching the sacrifice layer 105 constituting a lower surface portion of the vibration plate 111 (FIG. 5E).

(5) Then, on the lower electrode 108, a thin film of PZT was deposited by a sputtering method with a thickness of 2 μm and was calcined for 5 hours at 680° C. in an $O_2$ atmosphere to form a piezoelectric portion 109 (FIG. 5E).

(6) On the piezoelectric portion 109, Pt/Ti were deposited with respective thicknesses of 1500/50 Å (150/5 nm) to form an upper electrode 110. A same resist was also used for patterning the piezoelectric member 109 constituted of the PZT film. In this manner a piezoelectric element 108-110 was formed (FIG. 5E).

Figure 6A:
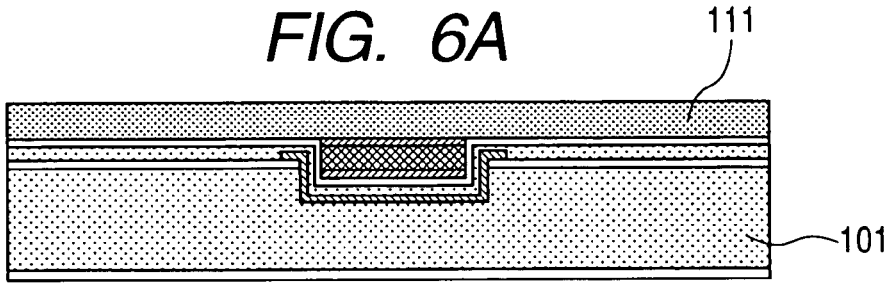
FIGS. 6A, 6B, 6C and 6D are views showing a process for producing an ink jet recording head embodying the present invention.

(7) Then, on thus formed piezoelectric element 108-110, a $SiN_x$ film was deposited for example by a plasma CVD method with a thickness 2 μm, and was patterned to form the vibration plate 111 (FIG. 6A). Thereafter, the $SiO_2$ film 107 was removed by a patterning in a portion where the liquid supply aperture 101*b* was to be formed.

Figure 6B:
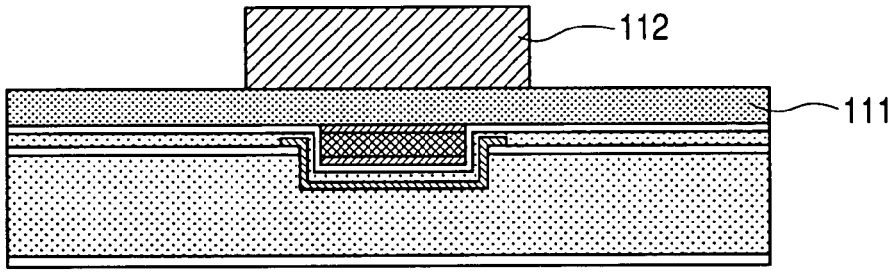

(8) On the vibration plate 111, a first pattern 112 serving as a mold for the pressure generation chamber 115 was formed by a spinner with a thickness of 60 μm, then dried and patterned (FIG. 6B). For the first pattern 112, PMER HM-3000PM (manufactured by Tokyo Oka Kogyo Co.) was employed.

Figure 6C:
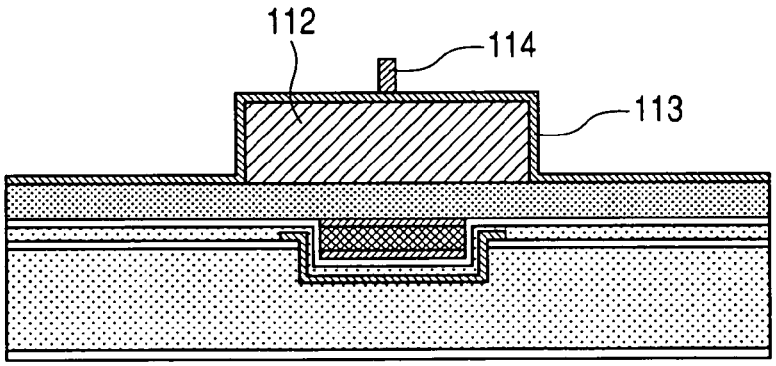

(9) On the vibration plate 111 and the first pattern 112, a conductive layer 113 to be used for plating was formed (FIG. 6C). The conductive layer 113 was formed by sputtering Ti/Cu with respective thicknesses of 250/750 Å (25/75 nm) followed by a patterning. The Ti layer was formed for improving adhesion of a Cu layer to the substrate and for improving the conductivity.

(10) On the conductive layer 113, a second pattern 114 serving as a mold for the discharge port was formed by a spinner with a thickness of 25 μm, then dried and patterned (FIG. 6C). For the second pattern 112, PMER LA-900PM (manufactured by Tokyo Oka Kogyo Co.) was employed, and an exposure apparatus of proximity type was employed for the exposure. At the exposure, the mask and the substrate were maintained with a gap of 100 μm to form the second pattern 114 of a tapered shape.

Figure 6D:
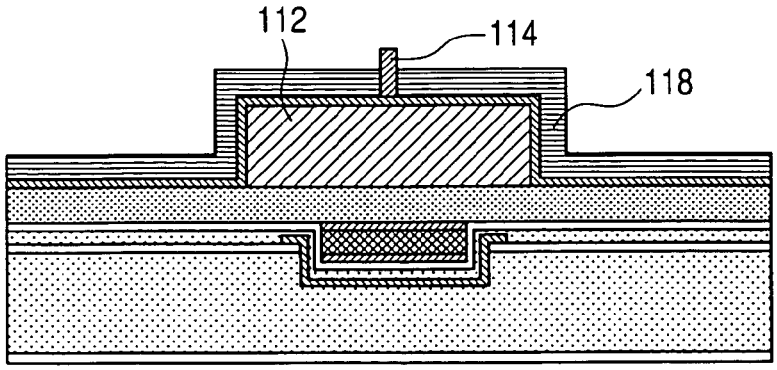

(11) Then, on the conductive layer 113, a Ni layer was formed with a thickness of 20 μm by an electrolytic plating, and a Ni-PTFE composite plating layer was formed with a thickness of 3 μm by an electroless plating, to form a flow path structural member 118 constituting a wall member of the pressure generation chamber 115 (FIG. 6D).

Figure 7A:
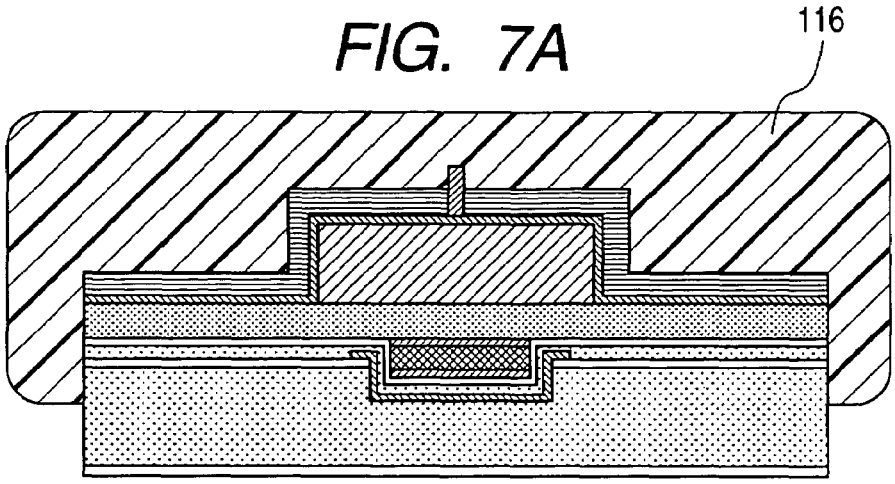
FIGS. 7A, 7B and 7C are views showing a process for producing an ink jet recording head embodying the present invention.

(12) Then, for protecting the upper surface side of the substrate 101, a cyclized rubber resin 116 was coated on the upper surface (FIG. 7A). As the cyclized rubber resin 116, OBC (manufacture by Tokyo Oka Kogyo Co.) was employed. Thereafter, the oxide film 102 on the lower surface side of the substrate 101 was etched in a parallelogram shape for forming the rear space 101*a* behind the vibration plate and the liquid supply aperture 101*b* shown in FIG. 2, and a laser working was applied in the vicinity of the narrower angle portion of the parallelogram to open a leading hole (not shown) in the substrate 101. The leading hole had a depth of 80% of the thickness of the substrate 101. Then, on the lower surface side of the substrate 101, an anisotropic etching was conducted for a predetermined period with TMAH 22 wt. % at 80° C. In this manner the rear space 101*a* behind the vibration plate and the liquid supply aperture 101*b* were formed on the substrate 101, and the sacrifice layer 105 in the rear space 101*a* was etched to form a space 120 around the piezoelectric element 108-110 (FIG. 7B).

Figure 7B:
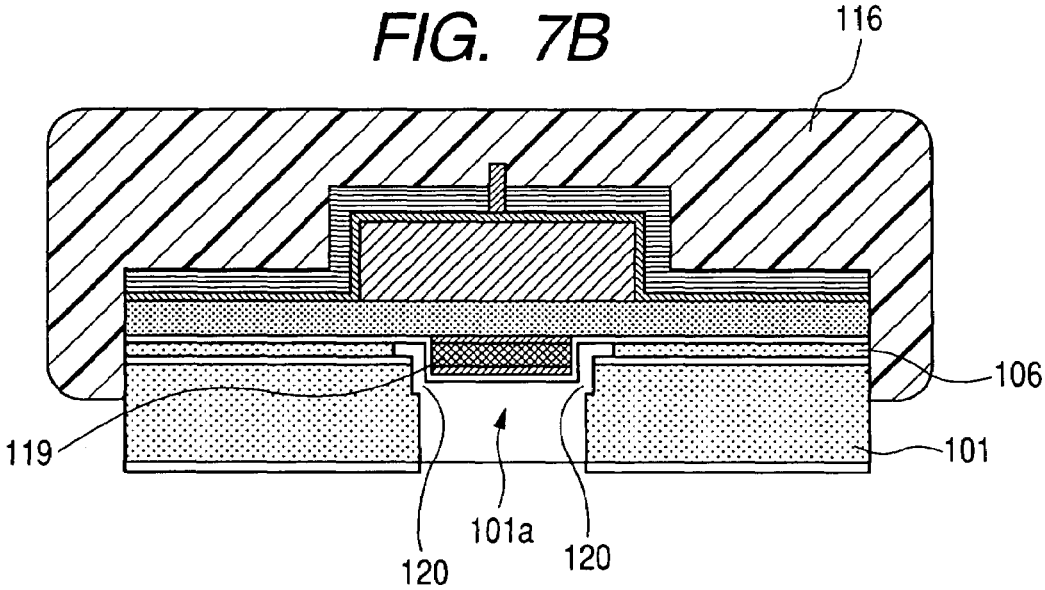
Figure 7C:
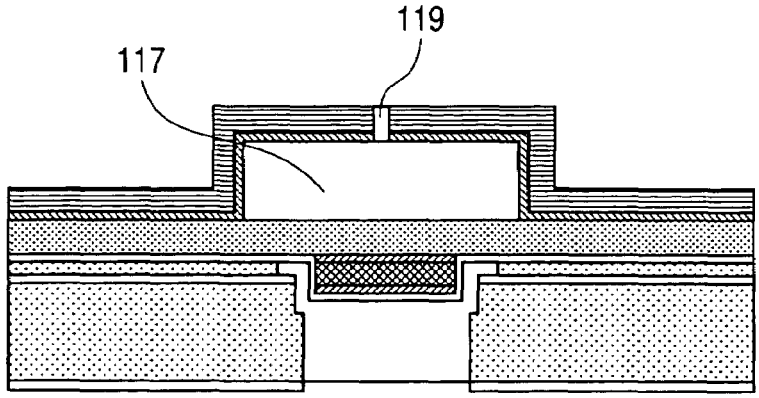

(13) After the anisotropic etching, the cyclized rubber resin 116 was removed with xylene, and the $Si_3N_4$ layer 106 serving as the etching stop layer, remaining on the lower surface side of the piezoelectric element 108-110, was removed by a chemical dry etching (CDE) (FIG. 7B). In this manner the piezoelectric element 108-110 was completed. Finally, the first and second patterns 112, 114 were removed with Direct Pass (manufactured by Arakawa Chemical Industries Co.) (FIG. 7C). Pine Alpha ST-380 (manufactured by Arakawa Chemical Industries Co.) was employed as its solvent.

In thus completed recording head, the discharge port 119 had a diameter of 15 μm at an upper side aperture, and a diameter of 30 μm at a lower side aperture. The wall member of the pressure generation chamber 115 had a thickness of 23 μm.

The rear space 101*a* behind the vibration plate had a longer side of 3 mm, and the liquid supply aperture 101*b* had a longer side of 500 μm.

In this recording head, an aqueous ink of a viscosity of 2 cp ($2\times10^{-3}$ Pa·s) was discharged from the discharge port 119 in a droplet of 3 pl at a discharge frequency of 25 kHz. As a result, a recording of a high quality, without a discharge failure, was obtained. Also the discharge performance did not show a change over discharges $1\times10^9$ times in a continuous discharge test.

EXAMPLE 3

In the following, another example of a producing process for the ink jet recording head of the present invention will be explained with reference to FIGS. 10A to 13.

Figure 10A:
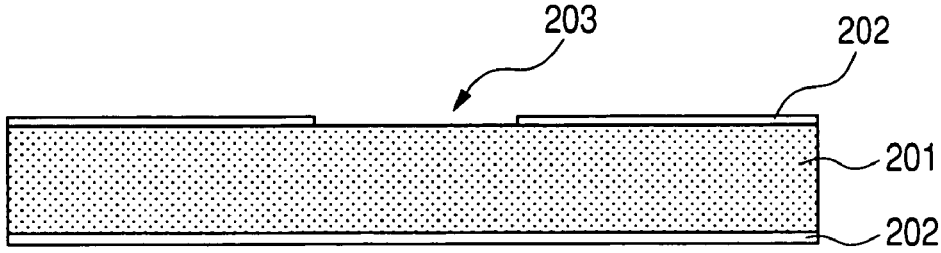
FIGS. 10A, 10B, 10C and 10D are views showing another process for producing an ink jet recording head embodying the present invention.

(1) A silicon substrate 201 having an external diameter of 150 mm and a thickness of 200 μm was thermally oxidized to form an oxide film 102 with a thickness of 6000 Å (600 nm), and the oxide film 102 of the upper side was partially etched to form an aperture 203 (FIG. 10A).

Figure 10B:
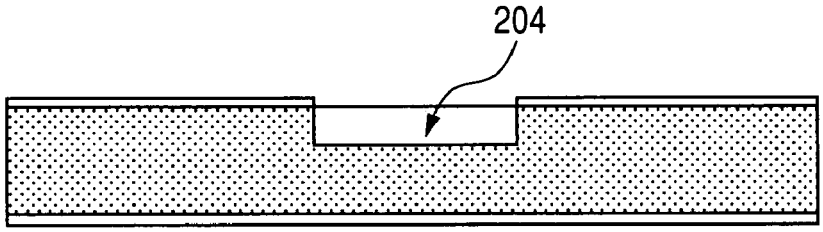

(2) The aperture 203 was etched by an ion-coupled plasma etching apparatus (ICP) to form a groove 204 of a depth of 3 μm (FIG. 10B).

Figure 10C:
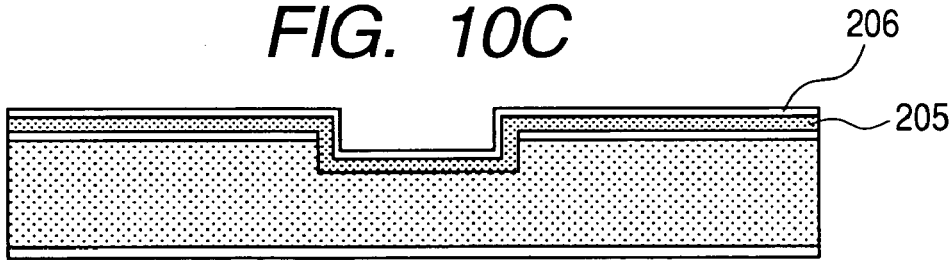

(3) On the upper surface side of the substrate 201, a $Si_3N_4$ layer 205 as an etching stop layer was deposited by an LPCVD method with a thickness of 3000 Å (300 nm), and a $SiO_2$ film 206 as a protective film was formed by a thermal CVD method with a thickness of 2000 Å (200 nm) (FIG. 10C).

Figure 10D:
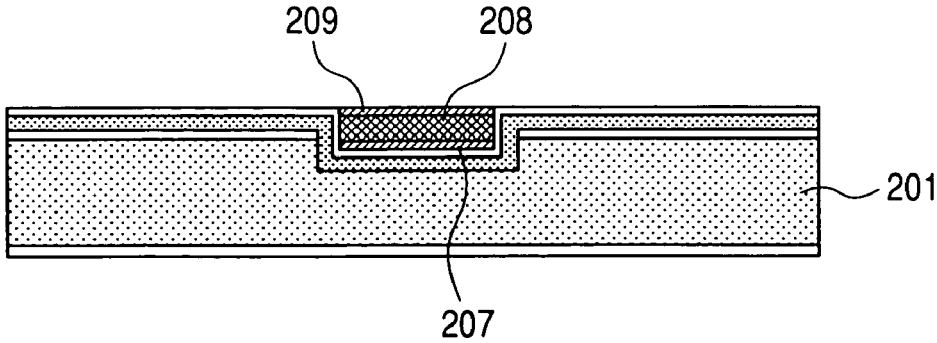

(4) Then, as shown in FIG. 10D, in the groove 204, Ti of a thickness of 50 Å (5 nm) and Pt of a thickness of 1500 Å (150 nm) were deposited by a sputtering method to form a lower electrode 207. On the lower electrode 207, monocrystalline PZT was deposited with a thickness of 2 μm by a sputtering method, and was annealed for 5 hours at 680° C. in an $O_2$ atmosphere to obtain a piezoelectric film 208. On the piezoelectric film 208, Ti of a thickness of 50 Å (5 nm) and Pt of a thickness of 1500 Å (150 nm) were deposited by a sputtering method to form an upper electrode 209.

Figure 11A:
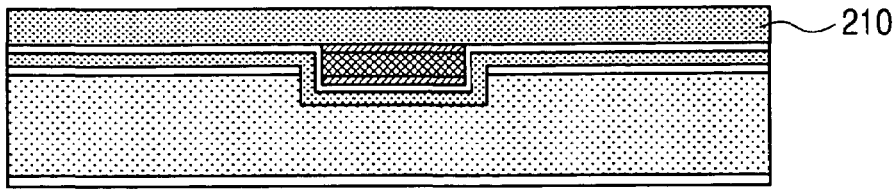
FIGS. 11A, 11B, 11C and 11D are views showing another process for producing an ink jet recording head embodying the present invention.

(5) On the upper surface of the substrate 201, a $SiN_x$ film was deposited with a thickness of 2 μm by a plasma CVD method and was patterned to form a vibration plate 210 (FIG. 11A). The $SiO_2$ film 206 in a portion to be connected with the liquid supply aperture (not shown) was removed by an etching.

Figure 11B:
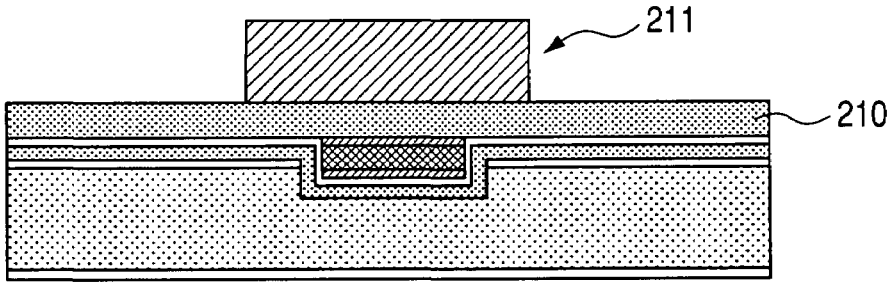

(6) On the upper surface of the substrate 201, a first pattern 211 serving as a mold for the pressure generation chamber was formed (FIG. 11B). The first pattern 211 was formed by coating PMER HM-3000PM (manufactured by Tokyo Oka Kogyo Co.) with a thickness of 60 μm by a spinner, followed by drying and patterning.

Figure 11C:
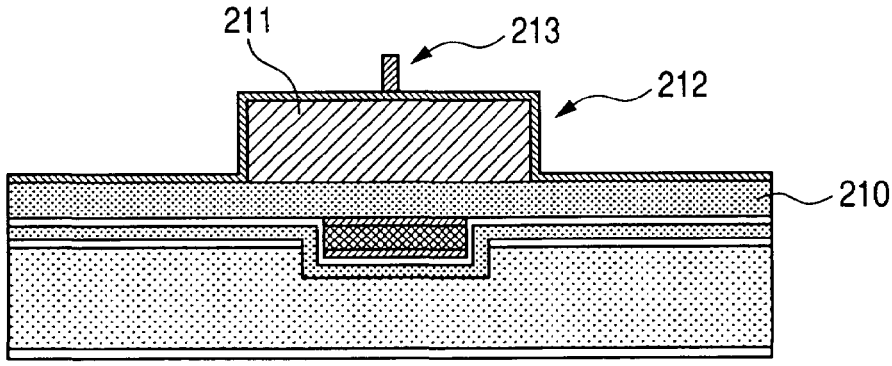

(7) On the vibration plate 210 and the first pattern 211, a conductive layer 212 to be used for plating was formed (FIG. 11C). The conductive layer 212 was formed by sputtering Ti/Cu with respective thicknesses of 250/750 Å (25/75 nm) followed by a patterning. The Ti layer was formed for improving adhesion of a Cu layer to the substrate and for improving the conductivity.

(8) On the conductive layer 212, a second pattern 213 serving as a mold for the discharge port was formed by a spinner with a thickness of 25 μm, then dried and patterned (FIG. 11C). For the second pattern 213, PMER LA-900PM (manufactured by Tokyo Oka Kogyo Co.) was employed, and an exposure apparatus of proximity type was employed for the exposure. At the exposure, the mask and the substrate were maintained at a gap of 100 μm to form the second pattern 213 of a tapered shape.

Figure 11D:
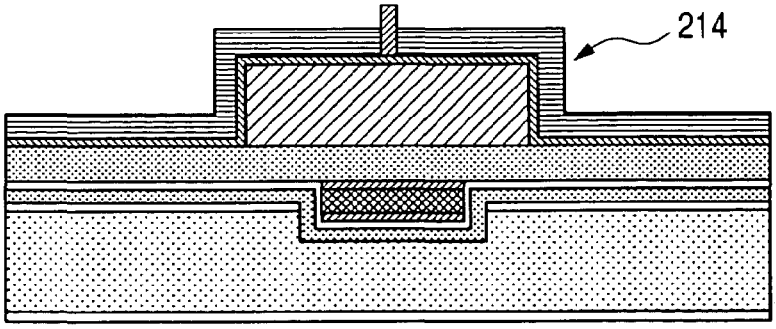

(9) Then, on the conductive layer 212, a Ni layer was formed with a thickness of 20 μm by an electrolytic plating, and a Ni-PTFE composite plating layer was formed with a thickness of 3 μm by an electroless plating, to form a flow path structural member 214 constituting a wall member of the pressure generation chamber (FIG. 11D).

Figure 12A:
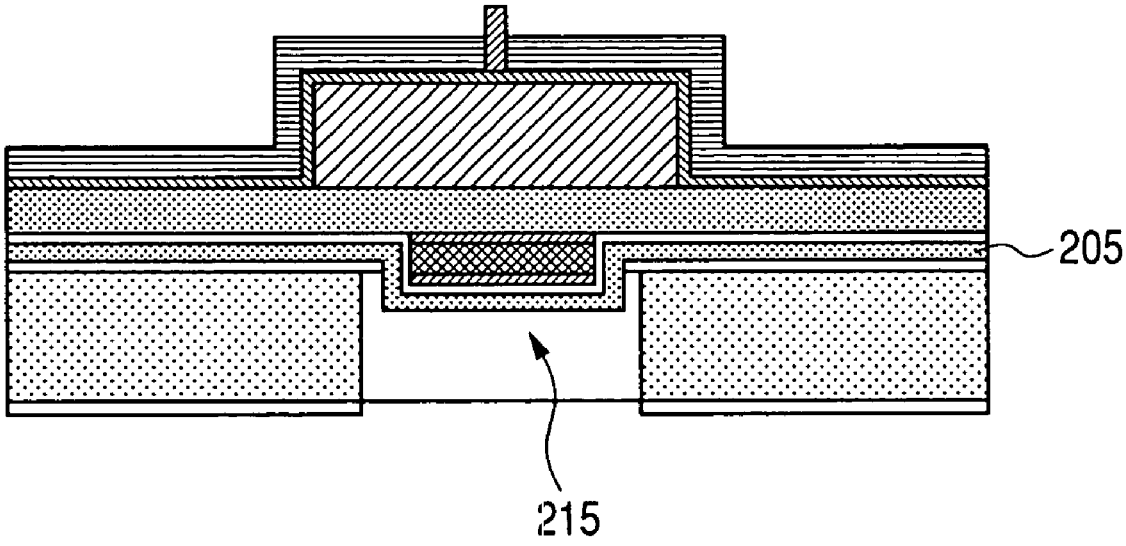
FIGS. 12A and 12B are views showing another process for producing an ink jet recording head embodying the present invention.
Figure 13:
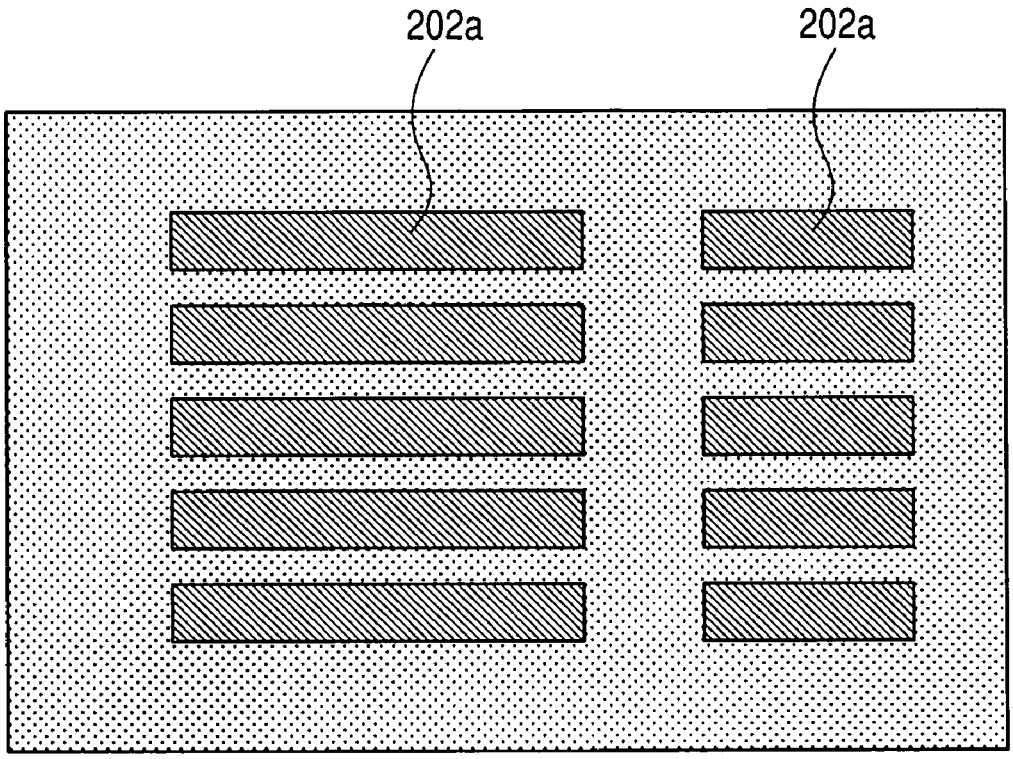
FIG. 13 is a view showing another process for producing an ink jet recording head embodying the present invention.

(10) Then, the oxide film 202 on the lower surface side of the substrate 201 was patterned (202*a*) in a rectangular shape for forming the rear space behind the vibration plate and the liquid supply aperture as shown in FIG. 13, and the Si substrate was ICP etched to the $Si_3N_4$ film 205 serving as an etching stop layer, thereby forming a rear space 201*a* behind the vibration plate and a liquid supply aperture (not shown) on the lower surface side of the vibration plate 210 (FIG. 12A). The $SiO_2$ film on the lower surface side of the substrate 201 was in such a pattern that a space 216 was formed around the piezoelectric element 207-209.

Figure 12B:
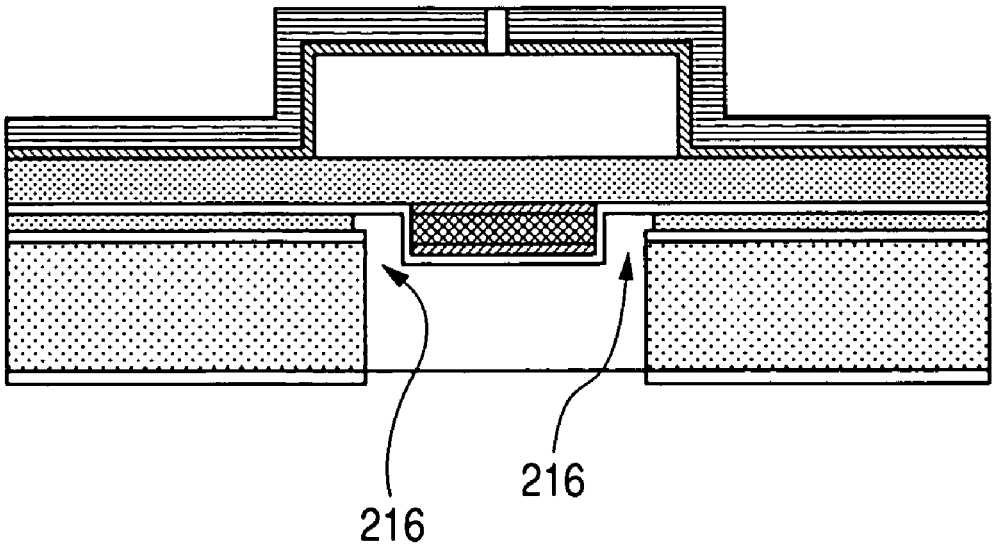

(11) The $Si_3N_4$ layer 205 serving as the etching stop layer was removed by a chemical dry etching (CDE), and finally the first and second patterns 211, 213 were removed with Direct Pass (manufactured by Arakawa Chemical Industries Co.) (FIG. 12B). Pine Alpha ST-380 (manufactured by Arakawa Chemical Industries Co.) was employed as its solvent.

In thus completed recording head, the discharge port had a diameter of 25 μm at an upper side aperture, and a diameter of 35 μm at a lower side aperture. The wall member of the pressure generation chamber had a thickness of 21 μm. Also the rear space 201*a* behind the vibration plate had a longer side of 3 mm, and the liquid supply aperture 201*b* had a longer side of 500 μm.

In this recording head, an aqueous ink of a viscosity of 2 cp ($2\times10^{-3}$ Pa·s) was discharged from the discharge port 119 in a droplet of 15 pl at a discharge frequency of 25 kHz. As a result, a recording of a high quality, without a discharge failure, was obtained. Also the discharge performance did not show a change over discharges $1\times10^{9}$ times in a continuous discharge test.

Figure 14:
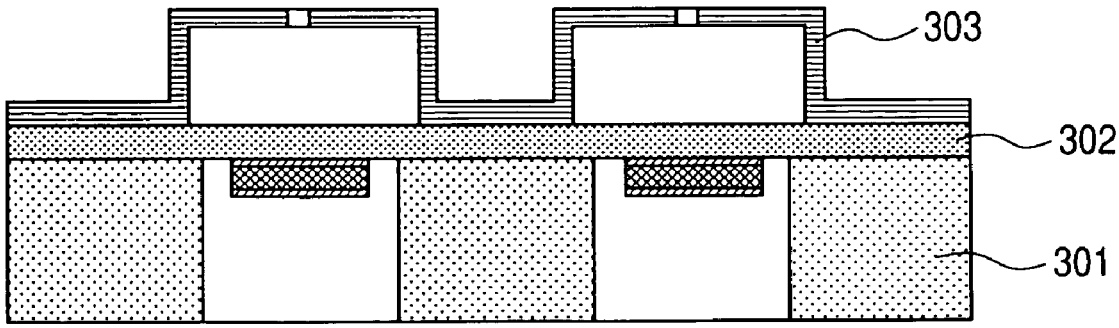
FIG. 14 is a cross-sectional view showing two adjacent nozzle portions in an ink jet recording head embodying the present invention.

FIG. 14 is a cross-sectional view showing two adjacent nozzle portions in an ink jet recording head prepared in Example 3.

EXAMPLE 4

Figure 15:
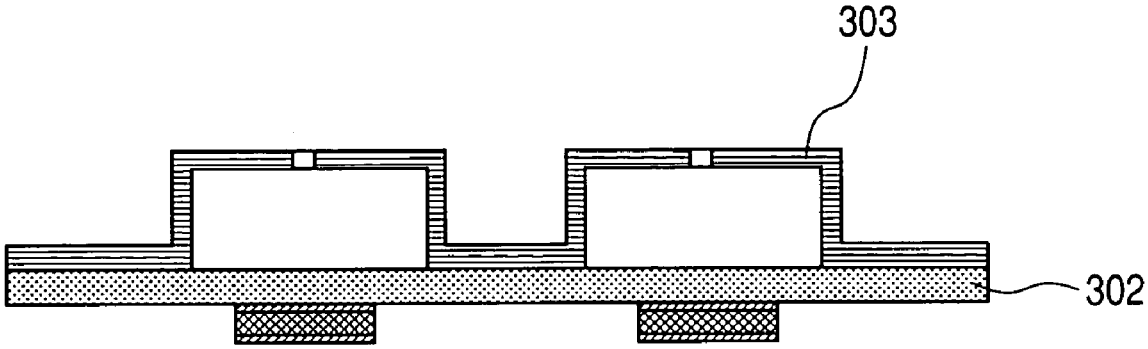
FIG. 15 is a cross-sectional view showing a variation of an ink jet recording head produced by the invention.

FIG. 15 shows a structure in which the Si substrate was entirely etched off by ICP, without forming the pattern 202*a* as shown in FIG. 13 on the lower surface side of the Si substrate, in the step (10) in Example 3.

COMPARATIVE EXAMPLE

Figure 16:
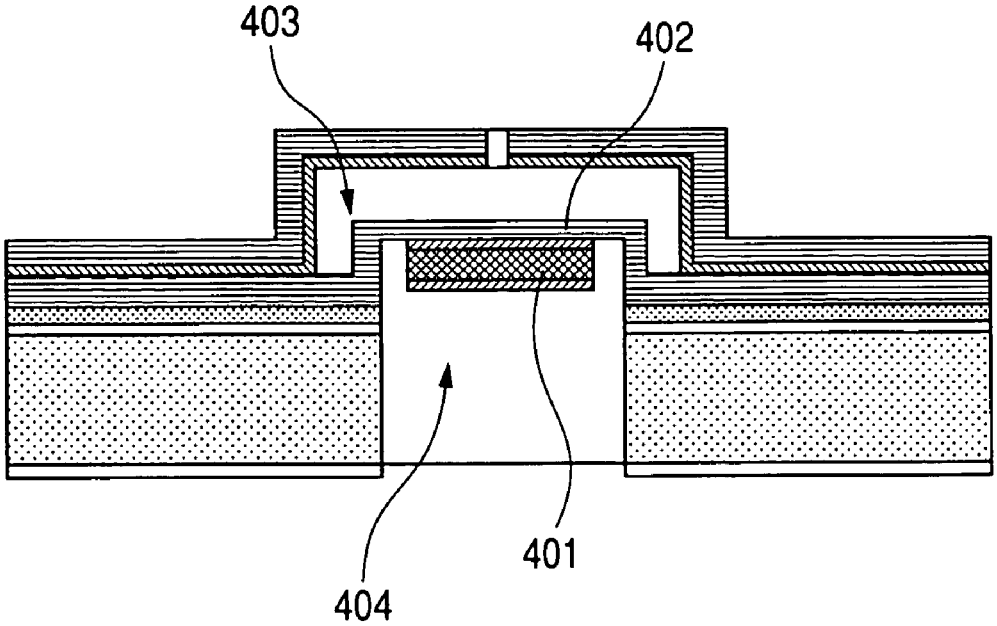
FIG. 16 is a cross-sectional view showing a comparative example of the ink jet recording head.

FIG. 16 shows a structure in which a piezoelectric element was prepared in laminated layers on the substrate, without forming a groove in the Si substrate in the step (1) of Example 2, and a rear space 404 behind the vibration plate was formed by forming a polysilicon sacrifice layer on the lower side and both sides of the piezoelectric element. When such ink jet recording heads were subjected to a continuous discharge test, the discharge became impossible in certain heads by a crack formation in a corner portion 403 of the vibration plate 302 after $3\times10^{7}$ discharges.

This application claims priority from Japanese Patent Application No. 2004-231026 filed Aug. 6, 2004, which is hereby incorporated by reference herein.

What is claimed is:

1. A producing method for an ink jet recording head including pressure generation chambers respectively communicating with discharge ports for discharging liquid, piezoelectric elements respectively provided corresponding to the pressure generation chambers, and a vibration plate commonly provided between the pressure generation chambers and the piezoelectric elements, the method comprising:

a providing step of providing a flat-shaped substrate;

a recess forming step of forming recesses in a main surface of the substrate by etching the main surface of the substrate;

a piezoelectric element forming step of forming the piezoelectric elements in the recesses, by depositing successive layers in the recesses so as to form the main surface of the substrate and the piezoelectric elements to be flat;

a vibration plate forming step of forming the vibration plate on the main surface of the substrate and the piezoelectric elements so as to form the vibration plate to be flat;

a pressure generation chamber forming step of forming the pressure generation chambers on the vibration plate; and a removing step of removing portions of the substrate in peripheral portions of the piezoelectric elements to form spaces surrounding the piezoelectric elements in the substrate.

2. A producing method for an ink jet recording head according to claim 1, further comprising, between the providing step and the piezoelectric element forming step:

a step of forming a sacrifice layer, capable of being selectively etched, in the recesses; and a step of forming a passivation layer, having an etching resistance, at least on the sacrifice layer.

3. A producing method for an ink jet recording head according to claim 2, further comprising:

a step of removing a part of the substrate and a part of the passivation layer thereby forming, in the substrate, a liquid supply aperture communicating with the pressure generation chambers.

4. A producing method for an ink jet recording head according to claim 1, wherein the pressure generation chamber forming step includes:

a step of forming a first pattern corresponding to the pressure generation chambers;

a step of forming, on the first pattern, a second pattern for constituting wall members of the pressure generation chambers; and a step of removing the first pattern, thereby forming the pressure generation chambers.

5. A producing method for an ink jet recording head according to claim 4, wherein the step of removing the first pattern thereby forming the pressure generation chambers is executed after the removing step.

6. A producing method for an ink jet recording head according to claim 1, wherein the substrate is constituted of silicon with a surface orientation {110}.

7. A producing method for an ink jet recording head according to claim 1, wherein the removing step is executed by a crystal axis anisotropic etching.

* * * * *